US010407286B1

(12) United States Patent
Bellis, Jr.

(10) Patent No.: US 10,407,286 B1
(45) Date of Patent: Sep. 10, 2019

(54) WINCH WITH ADJUSTABLE CABLE GUIDE

(71) Applicant: William B. Bellis, Jr., Louisville, KY (US)

(72) Inventor: William B. Bellis, Jr., Louisville, KY (US)

( * ) Notice: Subject to any disclaimer, the term of this patent is extended or adjusted under 35 U.S.C. 154(b) by 0 days.

(21) Appl. No.: 16/281,708

(22) Filed: Feb. 21, 2019

(51) Int. Cl.
*B66D 1/38* (2006.01)

(52) U.S. Cl.
CPC ..... *B66D 1/38* (2013.01)

(58) Field of Classification Search
CPC ..... B66D 1/36; B66D 1/38; B66D 1/42
See application file for complete search history.

(56) References Cited

U.S. PATENT DOCUMENTS 2,344,417 A * 3/1944 Schmidt ..... B66D 1/36 254/326
2,421,269 A * 5/1947 Joyce ..... B66D 1/36 242/397.3
2,595,655 A * 5/1952 Hannay ..... B65H 75/38 137/355.2
3,319,936 A * 5/1967 Askins ..... B60P 3/41 180/235
5,663,541 A * 9/1997 McGregor, II ..... H01H 1/20 200/17 R
5,967,496 A * 10/1999 Ulrich ..... B66D 1/36 242/157 R
6,631,886 B1 * 10/2003 Caudle ..... B66D 1/36 254/327
6,681,507 B1 * 1/2004 Lieziert ..... G09F 21/04 40/200
2001/0033783 A1 * 10/2001 Landoll ..... B60P 1/6454 410/77
2008/0131247 A1 * 6/2008 Nespor ..... B60P 3/07 414/494
2009/0146119 A1 * 6/2009 Bailey ..... B66D 1/12 254/323
2011/0168961 A1 * 7/2011 Christiansen ..... B66D 1/36 254/327
2016/0016766 A1 * 1/2016 Ho ..... B66D 1/38 242/397.3
2017/0320712 A1 * 11/2017 Shook ..... B66D 1/50
2017/0321851 A1 * 11/2017 Fretz ..... B63B 21/14

* cited by examiner

*Primary Examiner* — Emmanuel M Marcelo
(74) *Attorney, Agent, or Firm* — Duncan Galloway Egan Greenwald PLLC; Theresa Camoriano; Guillermo Camoriano

(57) ABSTRACT

A winch arrangement including a cable guide having a plurality of manually-repositionable guide surfaces to guide the cable as it is wound onto the winch drum.

7 Claims, 10 Drawing Sheets

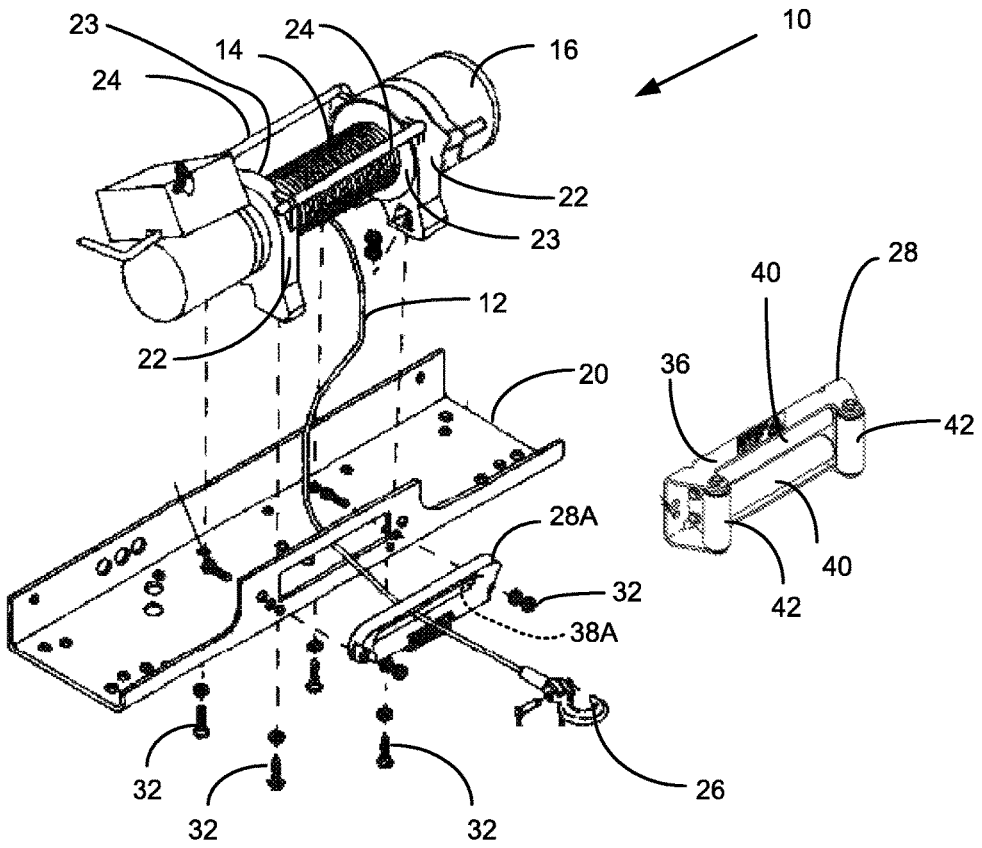
Prior Art Fig 1
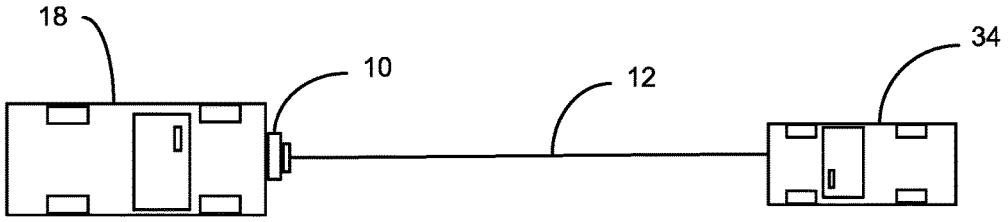
Fig 2

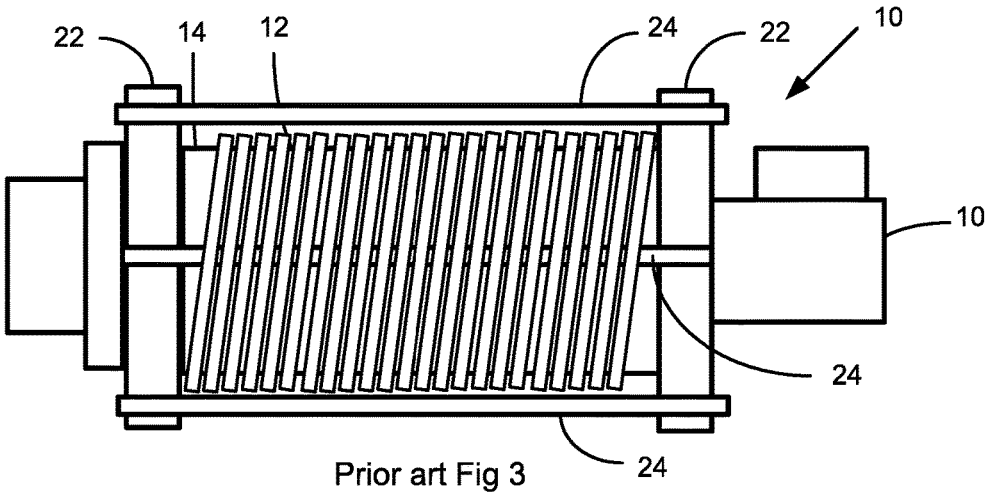
Prior art Fig 3
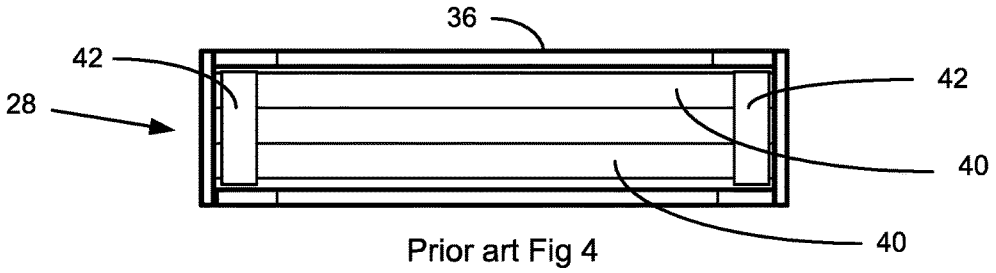
Prior art Fig 4
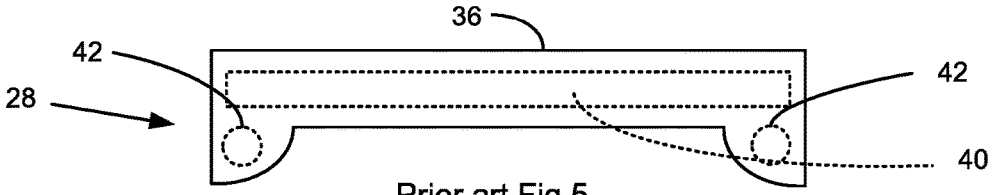
Prior art Fig 5
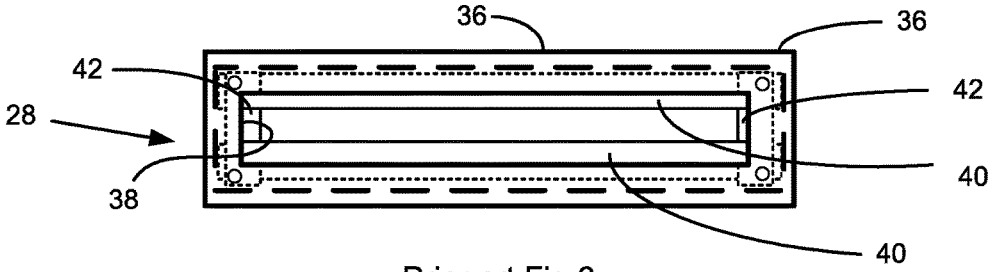
Prior art Fig 6

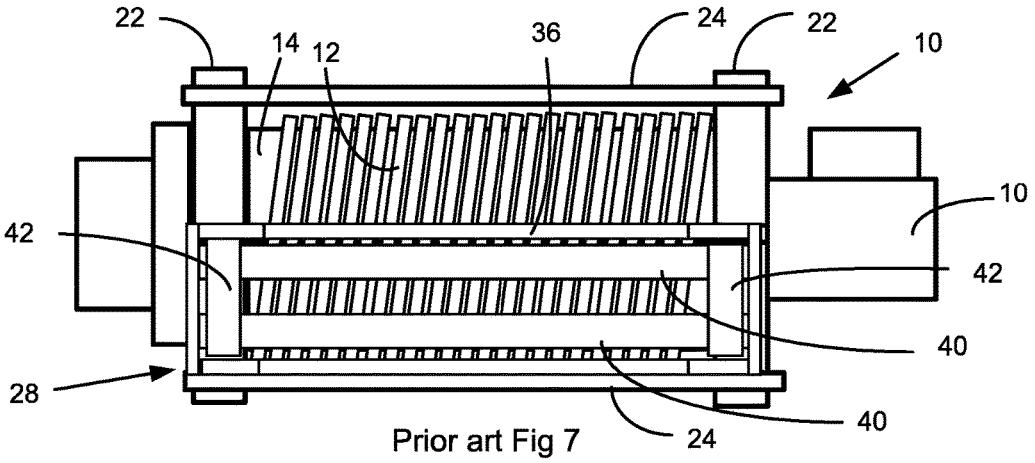
Prior art Fig 7
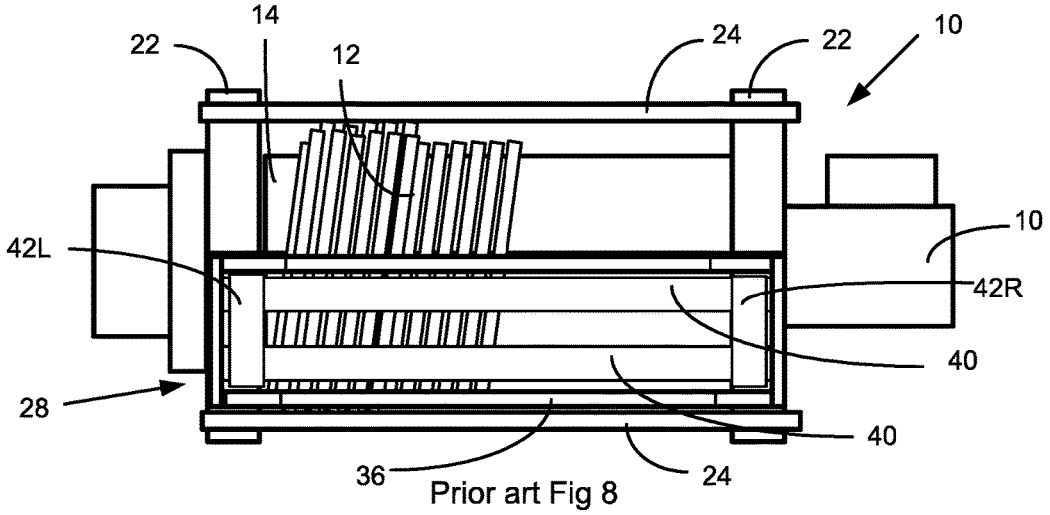
Prior art Fig 8
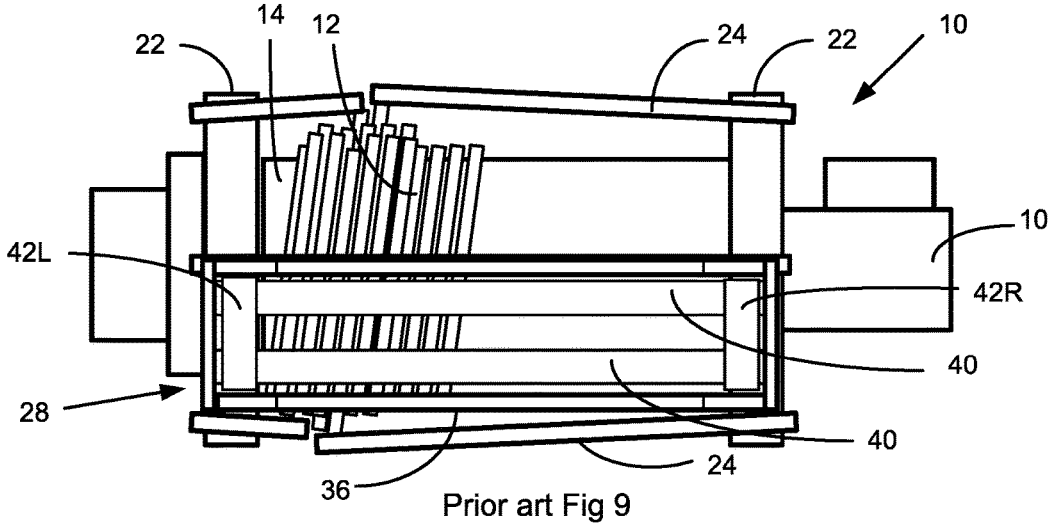
Prior art Fig 9

WINCH WITH ADJUSTABLE CABLE GUIDE

BACKGROUND

The present invention relates to a winch. More particularly, it relates to an adjustable cable guide for use with a winch.

For the casual user who has a winch mounted on an off-road vehicle, such as a Jeep™ or an ATV (All Terrain Vehicle), wherein the winch may be used for vehicle recovery when it gets stuck in mud, snow, or an embankment, a common problem is that the cable of the winch may bunch up on the winch drum. If the diameter of the bunched-up cable becomes large enough, it may exert a force on the framework of the winch, causing the framework to bend or break, which causes the winch to fail.

Winches used by professionals may have a powered drive mechanism to force and guide the cable to wind up evenly on the winch drum to prevent the cable from bunching up. However, these cable-guide mechanisms are complex, bulky, and expensive and are therefore not found, or even offered, on relatively small and comparatively inexpensive casual-use winches.

There is a need for a cable-guide mechanism for use with an inexpensive winch to prevent the cable from bunching up on the winch drum. The cable-guide mechanism needs to be simple and inexpensive so it can be supplied even for very inexpensive winches. The cable-guide mechanism needs to be simple to use, reliable, and able to operate in adverse environments, such as muddy or slushy-ice conditions.

SUMMARY

An embodiment of the present invention provides a cable guide for use with a winch. The cable guide includes a manually-repositionable guide surface to incrementally guide the cable as it is wound onto the winch drum.

BRIEF DESCRIPTION OF THE DRAWINGS

FIG. 1 is a partially exploded view of a prior art winch, including a mounting bracket, and two types of cable guides—a solid cable guide (also referred to as a hawse) and a roller cable guide (also referred to as a fairlead), and the cable;

FIG. 2 is a sketch of the winch of FIG. 1 on a first vehicle pulling a second vehicle in a substantially head-on configuration;

FIG. 3 is a front view of the prior art winch of FIG. 1, with the mounting bracket and the portion of the cable extending away from the drum not shown;

FIG. 4 is a front view of the prior art roller cable guide of FIG. 1;

FIG. 5 is a top view of the prior art prior art roller cable guide of FIG. 1;

FIG. 6 is a rear view of the prior art roller cable guide of FIG. 1;

FIG. 7 is a front view of the prior art winch and roller cable guide of FIG. 1 as the cable is wound onto the winch drum from a straight-on configuration as shown in FIG. 2;

FIG. 8 is a front view of the prior art winch and roller cable guide of FIG. 7 as the cable is wound onto the winch drum from a skewed configuration as shown in FIG. 21, with the cable starting to bunch up on the left side of the winch drum;

FIG. 9 is a front view of the prior art winch and roller cable guide of FIG. 8 as the cable is wound up further onto the winch drum from a skewed configuration, resulting in breakage of the winch frame;

DESCRIPTION

Figure 10:
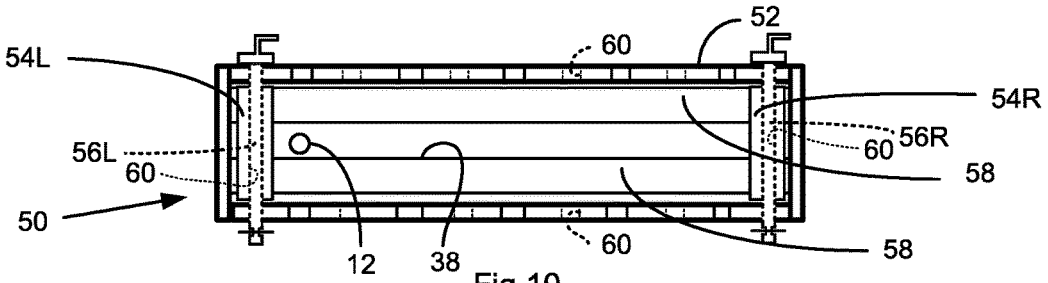
FIG. 10 is a front view of a cable guide made in accordance with the present invention.

FIGS. 1-9 show a typical prior art winch 10. A winch is a hauling or lifting device that includes a cable 12 winding around a rotating drum 14 which is turned by a motor 16 (or other power source). The winch typically is mounted to a vehicle 18 (See FIG. 2) via a mounting bracket 20, which puts the axis of rotation of the drum 14 in a horizontal position.

As indicated above, the winch 10 includes a drum 14 having a left-to-right axis of rotation, a drum length in the direction of this axis of rotation, and a center point along this drum length. The drum 14 has two end flanges 23 and is driven for rotation in clockwise and counterclockwise directions relative to a fixed frame by a motor 16. Typically, the motor 16 is an electric motor which is operated from a 12 volt battery (not shown) on the vehicle 18. The fixed frame includes end plates 22 and a plurality of transverse rods 24 which secure the end plates 22 together to provide rigidity and structural integrity to the winch 10.

The cable 12 may be a metal cable, a rope (typically a synthetic material rope), or even a chain. In this application, when the word "cable" is used, it is understood to include a cable, a rope, a chain, or anything similar that can wrap around the winch drum and support a load. One end of the cable 12 is secured to the drum 14, and the cable winds around the drum 14 as the drum 14 rotates. The free end of the cable 12, which may include a hook 26, passes through a cable guide 28A or 28. The prior art cable guide 28A is a solid piece of metal (in which case it is often referred to as a hawse 28A), and the alternative prior art cable guide 28 is a roller cable guide 28, which includes a plurality of rollers 30 (in which case it is often referred to as a fairlead 28), The purpose of the cable guide 28 or 28A is to guide the cable 12 as it unwinds from, and especially as it winds back onto, the drum 14.

Referring briefly to FIGS. 1, and 4-6, the prior art roller cable guide 28 includes a cable guide bracket 36 (this cable guide bracket 36 is mounted to the mounting bracket 20, preferably via bolts 32). The cable guide bracket 36 defines a substantially rectangular opening 38. See FIG. 6 which is a rear view of the cable guide 28. (The alternative cable guide 28A also has a rectangular opening 38A.) The prior art roller cable guide 28 includes two horizontally oriented rollers 40, and two vertically oriented rollers 42. The cable 12 leaving the winch drum 14 extends through the opening 38, and through the space between the rollers 40, 42 to help guide the cable 12.

As shown in FIG. 1, the winch 10 is mounted onto a mounting bracket 20 via a plurality of fasteners, such as bolts 32, The cable guide 28 or 28A also is secured to the mounting bracket 20 (or it may be secured directly to the end plates 22 of the winch 10), and the entire assembly (winch 10, cable guide 28, and mounting bracket 20) is secured to the frame of the vehicle 18.

In an ideal winching situation, the vehicle 18 is positioned so that its winch 10 is in a head-on configuration to the vehicle 34 (See FIG. 2) being rescued (note that the vehicle 34 being rescued may instead be an anchor point 34 for the vehicle 18 to use in order to pull itself out when it is stuck). In this head-on configuration, the winch 10 tends to wind up back onto the drum 14 in an orderly manner as shown in FIGS. 3 and 7, with each coil of the cable 12 being displaced laterally along the longitudinal dimension of the drum 14 by the previously laid coils of the cable 12.

Figure 21:
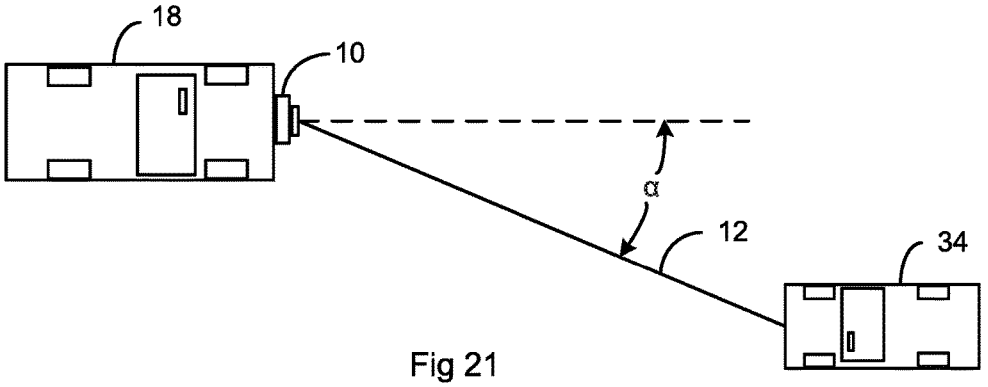
FIG. 21 is a sketch of a winch on a first vehicle winching a second vehicle in a skewed configuration.

It should be noted that this "ideal" head-on winching configuration, as shown in FIG. 2, is not typical. FIG. 21 shows a more common skewed winching configuration wherein the vehicle 18 with the winch 10 is at an angle $\alpha$ relative to the vehicle 34 to be rescued (or relative to the fixed point 34) such that the winch 10 must reel in the cable 12 at an angle instead of head-on as shown in FIG. 2.

In this skewed winching configuration, as shown in FIGS. 21, 8 and 9, the cable 12 is constantly pressing against the left guide surface 42L of the roller cable guide 28, (If the solid prior art cable guide 28A were used, the cable would be pressing against the left end of the opening 38A.) In this case, the cable 12 winds back primarily onto the leftmost portion of the drum 14 of the winch 10, as best shown in FIG. 8. As the winch 10 continues to reel in the cable 12 onto the drum 14, the cable 12 may bunch up so much that it impacts against one or more of the rods 24. The pressure imparted by the bunching cable 12 on the rods 24 eventually may cause one or more of the rods 24 to bend and break, resulting in the failure of the winch 10, as shown in FIG. 9. This same failure mode of breakage of the rods 24 due to undue pressure by the cable 12 may occur when the cable 12 bunches up in any one area of the drum 14.

FIGS. 10-19 show a first cable guide 50 made in accordance with the present invention. This cable guide 50 may be used in new winches or easily may be retrofitted onto existing winches 10 by replacing the existing cable guide 28, 28A with this cable guide 50.

Figure 11:
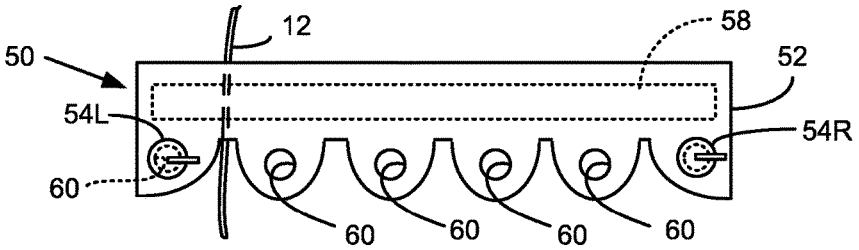
FIG. 11 is a top view of the cable guide of FIG. 10, with the cable broken away.
Figure 22:
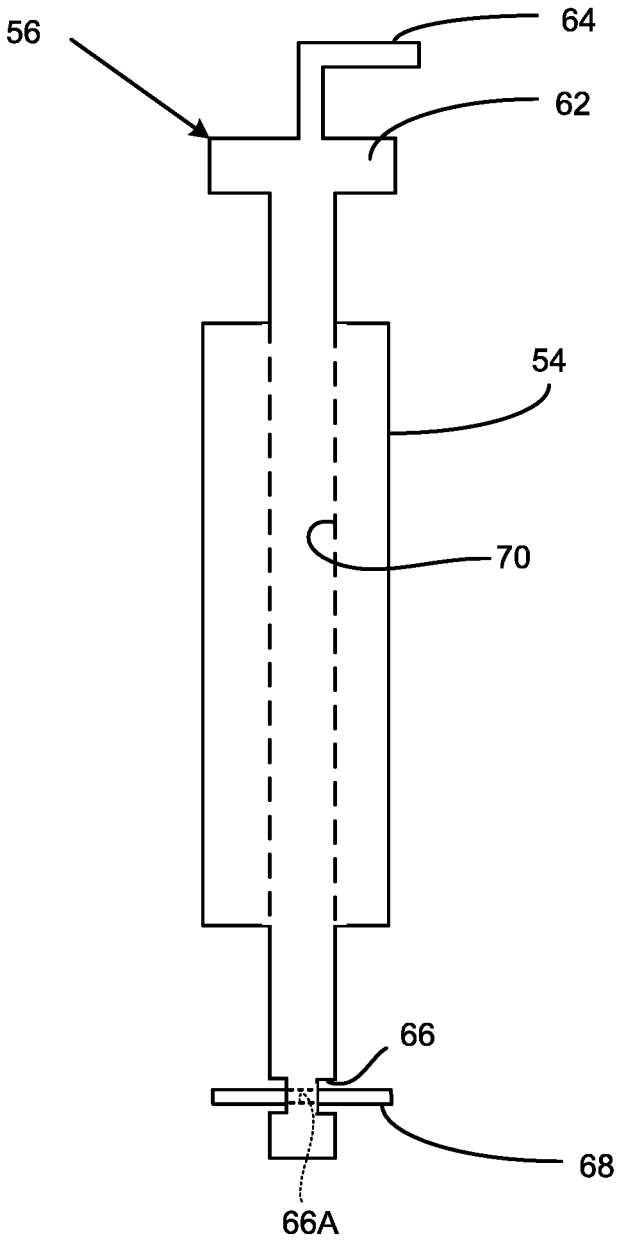
FIG. 22 is a side view of one of the vertical guides of FIGS. 10-20.

Referring to FIGS. 10 and 11, the cable guide 50 is similar to the prior art roller cable guide 28. It includes a bracket 52 extending in a left-to-right direction, and left and right guide surfaces 54L, 54R removably mounted on the bracket 52. In this case, the guide surfaces 54L, 54R are the curved outer surfaces of rollers, which may or may not be rotatable about their respective mounting pins 56L, 56R. In this case, the guide surfaces 54L, 54R are cylindrical, but other gently curved shapes could be used instead, if desired. The left guide surface 54L is supported on a first pin 56L, and the right guide surface 54R is supported on a second pin 56R. An enlarged view of one of the pins 56 and its respective guide surface 54 is shown in FIG. 22. The left and right pins 56L, 56R and left and right guide surfaces 54L, 54R are identical. (It should be noted that the pin itself 56 may be appropriately contoured to provide the gently curved guide surface.)

The cable guide 50 also includes upper and lower horizontal guide surfaces 58 which are substantially identical to the rollers 40 on the prior art cable guide 28 of FIG. 1. Again, these curved guide surfaces 58 may or may not be rotatable about their respective mounting pins, or the mounting pins themselves may be appropriately contoured to provide the guide surfaces without the need for an additional roller guide surface.

The bracket 52 defines a plurality of sets of upper and lower, vertically aligned, paired openings 60 which are spaced-apart across the bracket 52, with at least a leftmost set of upper and lower paired openings 60 located to the left of the center point of the drum 14, at least a rightmost set of upper and lower paired openings 60 located to the right of the center point, and at least one intermediate set of upper and lower paired openings 60 located intermediate the leftmost and rightmost sets. In the embodiment 50 shown in FIGS. 10-20, there are three sets of upper and lower paired openings 60 located to the left of the center point and three sets of upper and lower paired openings 60 located to the right of the center point of the drum 14. Each set of upper and lower paired openings 60 can receive one of the pins 56. In this embodiment, the upper and lower paired openings 60 are identical to each other, being circular openings having the same diameter and vertically aligned with each other.

In a first mounting position, when the left pin 56L is in the leftmost set of upper and lower paired openings 60, and the right pin 56R is in the rightmost set of upper and lower paired openings 60, as shown in FIGS. 10 and 11, the pins 56L, 56R are mounted far enough apart so that the space defined between the left and right guide surfaces 54L, 54R is sufficient to enable a cable 12 to wind along the entire drum length.

Referring to FIG. 22, the guide surface 54 is a hollow cylindrical body supported on the pin 56. The hollow cylindrical body 54 may or may not be rotatable on the pin 56. The pin 56 defines a head 62 and a handle 64 projecting upwardly from the head 62 to assist the user in the removal and reinstallation of the pin 56, as explained in more detail later. The end of the pin 56 lying opposite to the head 62 provides some type of securement. In this case, there is a circumferential indentation 66 with a hole 66A. One leg of an R clip 68 (also referred to as a hair pin cotter) is inserted through the hole 66A, and the other leg of the R clip 68 rests in the indentation 66 to secure the R clip 68 to the pin 56, so the R clip 68 provides the securement. The head 62 of the pin 56 is too large to pass through the upper openings 60, and the R clip 68 is too large to pass through the lower openings 60, so, once the pin 56 has been inserted through the pair of openings 60, the pin 56 is secured to the frame 52 of the cable guide 50.

It should be noted that many other known types of securements may be used to secure the pin 56 to the frame 52. For instance, the lower end of the pin 56 may be made as a Quick-Release detent Clevis Pin. This is essentially a cotterless Clevis Pin that features a ball detent that depresses and springs out to hold the Clevis Pin in place. The pin 56 alternatively may be a bolt which threads into the bottom of the frame 52 or which is secured to the frame 52 with a nut (not shown). In that case, the threading onto the bottom of the frame 52 or onto the nut would provide the securement, which prevents the pin 56 from moving upwardly, out of the bottom opening 60.

It also may be desirable to magnetize the head 62 on the pin 56, such that when the pin 56 is installed through its corresponding set of vertically aligned, upper and lower paired openings 60, and the magnetized head 62 abuts the frame 52, the magnetized head 62 secures itself to the frame 52 by magnetic attraction (assuming, of course, that the frame 52 of the cable guide 50 is made of a ferro-magnetic material).

In this embodiment, the guide surface 54 has a larger diameter than the paired openings 60. To mount the guide surface 54 of FIG. 22 onto the frame 52, the guide surface 54 is first placed in a vertical orientation with its axial opening 70 (See FIG. 22) aligned with a first set of vertically aligned, upper and lower paired openings 60 (as shown, for example, in FIGS. 10 and 11). A pin 56 is inserted downwardly, through the upper opening 60, through the axial opening 70, and through the lower paired opening, and a clip 68 or other securement is installed at the lower end of the pin 56.

In a skewed winch configuration as shown in FIG. 21, where the car 34 to be rescued or the fixed point 34 to be used for pulling the car 18 out is off to the left side, the cable 12 is likely to bunch up on the leftmost end of the winch 10 until it causes failure of the winch 10 due to breakage of the rods 24, unless an intermediate guide surface can be provided as described below.

The cable guide 50 is initially set up as shown in FIGS. 10 and 11 wherein the first pin 56L is mounted in the leftmost set of upper and lower paired openings 60, and the second pin 56R is mounted in a the rightmost set of upper and lower paired openings 60, thereby defining a space 38 between the left and right guide surfaces 54L, 54R for receiving the cable 12 to pass through the space 38 and onto the drum 14. This space is long enough to permit the cable 12 to wind up onto the full length of the drum 14.

Figure 12:
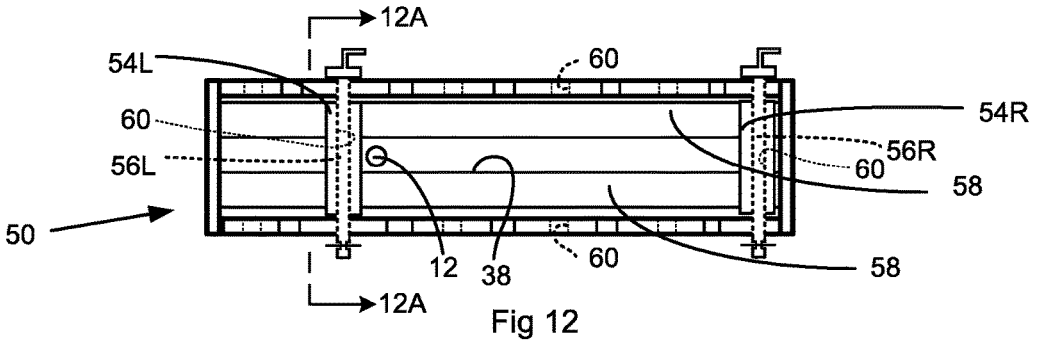
FIG. 12 is a front view of the cable guide of FIG. 10 with its leftmost guide surface repositioned and moved over one slot to the right.
Figure 13:
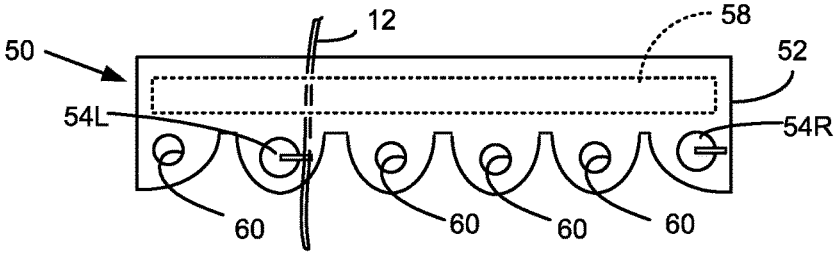
FIG. 13 is a top view of the cable guide of FIG. 12.
Figure 12A:
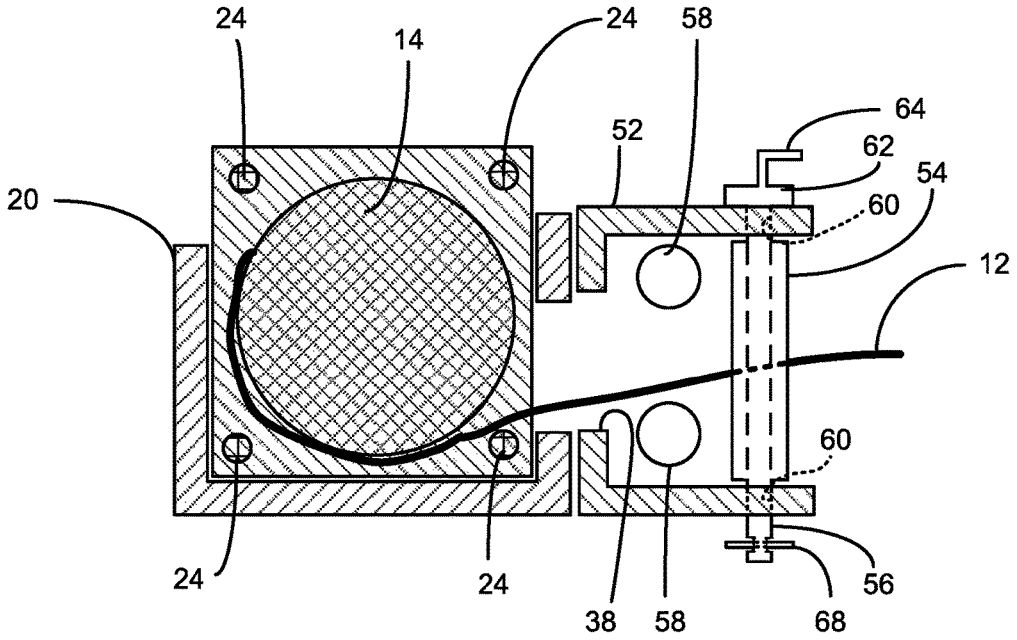
FIG. 12A is a section view along line 12A-12A of FIG. 12.
Figure 14:
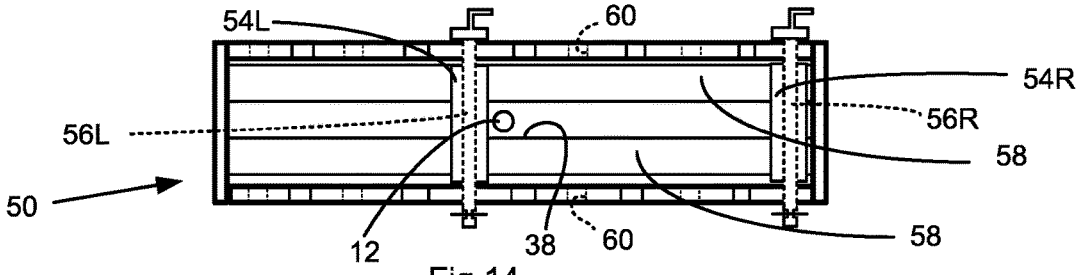
FIG. 14 is a front view of the cable guide of FIG. 12 with its leftmost guide surface repositioned and moved over one slot to the right.
Figure 15:
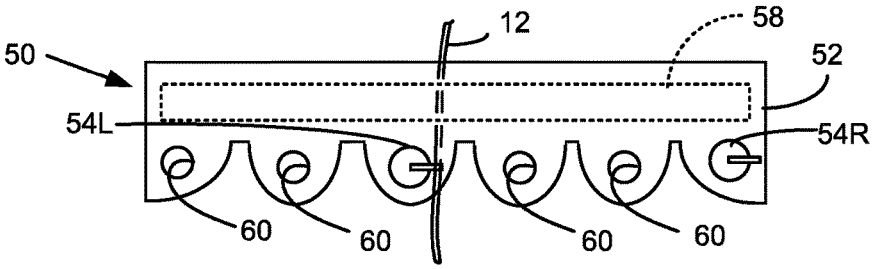
FIG. 15 is a top view of the cable guide of FIG. 14.
Figure 16:
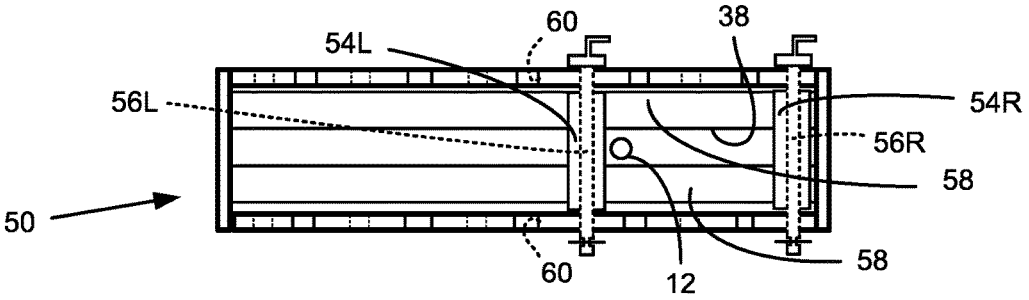
FIG. 16 is a front view of the cable guide of FIG. 14 with its leftmost roller repositioned and moved over one slot to the right.
Figure 17:
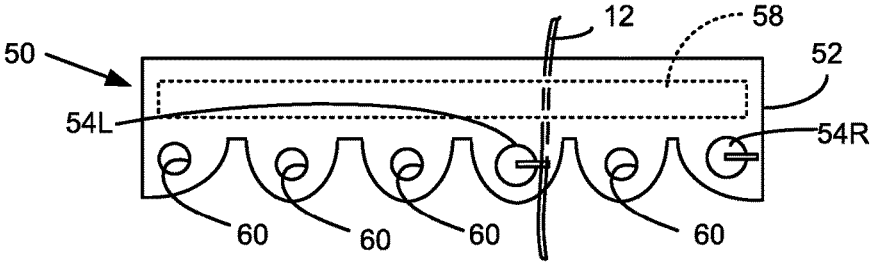
FIG. 17 is a top view of cable guide of FIG. 16.
Figure 18:
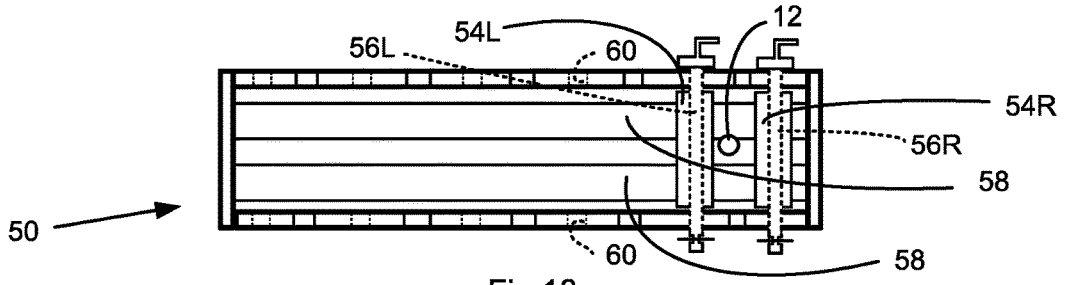
FIG. 18 is a front view of the cable guide of FIG. 16 with its leftmost roller repositioned and moved over one slot to the right.

As the cable 12 begins to wind up onto the leftmost portion of the drum 14, the winch is momentarily stopped and the tension on the cabled 12 is slightly released (which may require the load being winched to be chocked to prevent its movement while the tension on the cable 12 is released) so that the left most pin 56L and its corresponding guide surface 54L may be removed and reinstalled in an intermediate set of vertically aligned, upper and lower paired openings 60, as shown in FIGS. 12 and 13. It may be noted that this second set of vertically aligned, upper and lower-paired openings 60 is a bit to the right of the leftmost set of vertically aligned, upper and lower paired openings 60, where the pin 56L and guide surface 54L were initially mounted. Then the winch is restarted, and the cable 12 will now wind up onto the drum 14 to the right of the new position of the guide surface 54L, at an area of the drum 14 which is to the right of the area of the drum 14 where the cable 12 initially wound onto the drum 14.

This intermediate position of the guide surface 54L provides a shorter space for the cable 12 to pass through, thereby directing the cable onto a more specific portion of the drum 14.

It should be noted that, instead of moving the leftmost guide surface to an intermediate position, another guide surface may be provided and manually installed in that intermediate position.

As the cable 12 winds up onto the drum 14, the intermediate guide surface is moved sequentially to various intermediate positions as depicted in FIGS. 14-19. Each time, the pin 56L and guide surface 54L are moved incrementally to the right, and the cable 12 is urged by the guide surface 54L to wind up onto the drum 14 in an area of the drum 14 which is away from (and to the right of) the area of the drum 14 where the cable 12 has already been wound on the drum 14. (It should be noted that the left and right pins 56L, 56R are independently movable relative to the frame 52 and each may be mounted in any one of the paired upper and lower openings 60.)

As an alternative, the left guide 54L (or another intermediate guide) may start farther toward the right end, and then may be moved gradually toward the left end to help the cable 12 wind up evenly on the drum 14 and prevent bunching on the drum 14.

If the load were off to the right of the winch, so that the cable 12 would tend to bunch up on the right side of the drum 14, then the right pin 56R (or some other pin) would be sequentially shifted from right to left or from left to right, with the cable 12 on the left side of the intermediate guide surface to urge the cable 12 to wind up evenly onto the drum 14. It is preferred that the cable 12 lie between two guide surfaces as it is winding onto and off of the drum 14, whether the guide surfaces are in the leftmost, rightmost, or intermediate positions.

Figure 19:
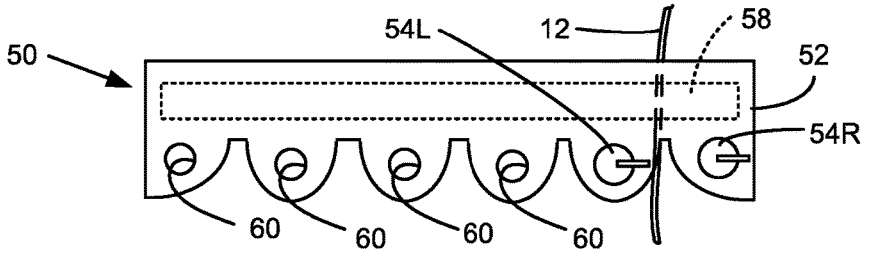
FIG. 19 is a top view of cable guide of FIG. 18.
Figure 20:
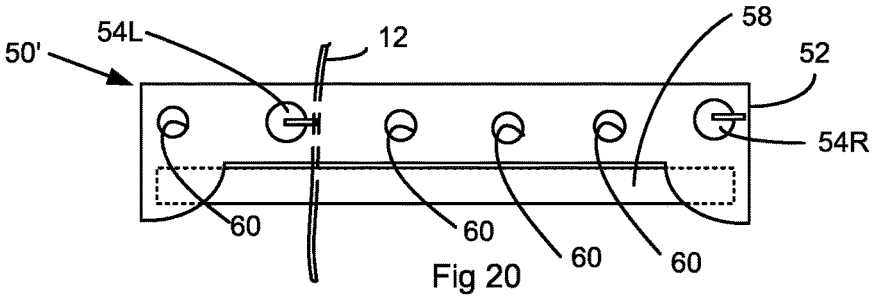
FIG. 20 is a top view of an alternative embodiment of a cable guide, similar to that of FIG. 13 but with the relative positions of the vertical and horizontal rollers of the fairlead reversed such that the vertical rollers are now behind the horizontal rollers.

FIG. 20 shows an alternative cable guide 50' which is very similar to the cable guide 50 of FIG. 19 except the position of the horizontal guide surfaces 58 relative to the vertical guide surfaces 54 is reversed. The horizontal guide surfaces 58 are now in the front of the cable guide 50', and the vertical guide surfaces 54 are located toward the back of the cable guide 50', behind the horizontal rollers 58. Other than this difference, the cable guide 50' operates in substantially the same manner as the previous cable guide 50 described above.

Figure 23:
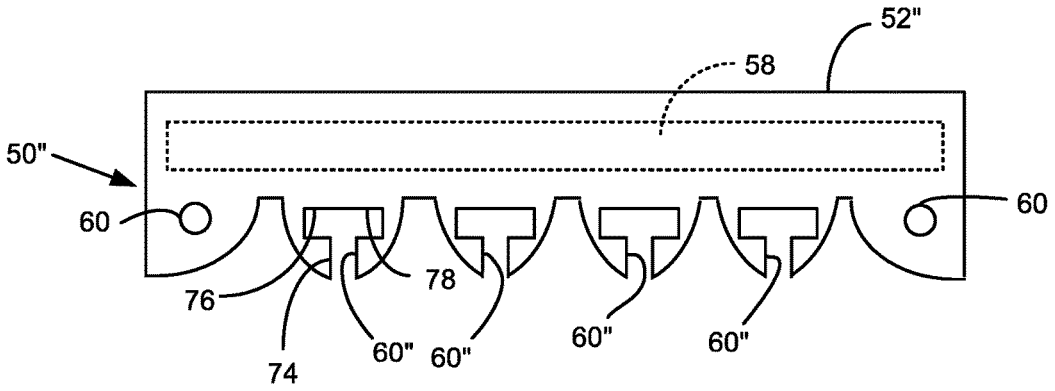
FIG. 23 is a top view of an alternative embodiment of a cable guide, similar to that of FIG. 11, but using slotted openings.

FIG. 23 is a top view of another embodiment of a cable guide 50". This cable guide 50" is similar to the cable guide 50 of FIGS. 10-19 but in this embodiment, only the endmost upper and lower pairs of openings 60 are circular. The other upper and lower paired openings 60" are upper and lower pairs of "T"-shaped, slotted openings 60". In this embodiment, the upper and lower slotted openings 60" are identical to each other and are vertically aligned. Of course, all of the paired openings could be "T"-shaped, slotted openings, if desired.

Figure 24:
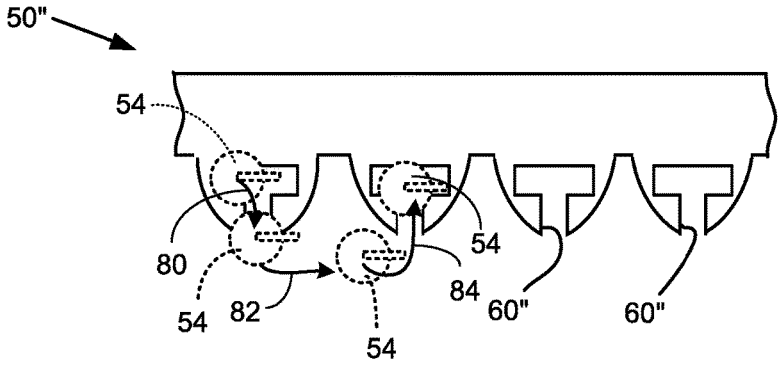
FIG. 24 is the same as FIG. 23, but with the ends of the frame broken away and showing a guide surface (in phantom) as it is moved from one slotted opening to the next.

Each of the slotted openings 60" defines a leg 74, a left arm 76, and a right arm 78. FIG. 24 shows a guide surface 54 and its respective pin being moved from one slotted opening 60" to an adjacent slotted opening 60" without having to remove the pin 56 from the guide surface 54. In the example shown in FIG. 24, the guide surface 54 is shown in phantom in four positions, starting at the leftmost position where the guide surface 54 is in the left arm portions 76 of the first set of upper and lower paired slotted openings 60". The guide surface 54 is moved in the direction of the arrow 80 to slide it out of the left arm 76 and into the leg 74 of the slotted opening 60". Next, the guide surface 54 is moved in the direction of the arrow 82 to slide it out of the leg 74 and into a position just outside the adjacent slotted opening 60". Next, the guide surface 54 is moved in the direction of the arrow 84 to slide it into the leg 74 of the adjacent slotted opening 60" where it may be slid to its final location on either one of the arms 76, 78 of the slotted opening 60", as needed. Of course, the right pin 56 and its respective guide surface 54 also are independently movable from one paired set of upper and lower openings 60", as in the previous embodiment.

The advantage of the above arrangement of a cable guide 50" with slotted openings 60" is that, at least in the area utilizing the slotted openings 60", there is no need to remove a securement and to separate the pin 56 from the guide surface 54 in order to move from one set of paired upper and lower openings 60" to the next. The pin and guide surface assembly 56, 54 simply slides out of the slotted opening 60" and is moved on to the next set of paired slotted openings. For this arrangement, it may be advantageous to have a pin 56 with a magnetic head 62 to help secure the pin and guide surface assembly 56, 54 to the frame 52" of the cable guide 50" when the cable 12 is not pushing against the guide surface 54 in the left or right direction. When the cable 12 is pushing leftwardly or rightwardly on the guide surface 54, the force exerted on the guide surface 54 by the cable 12 helps keep the pin and guide surface assembly 56, 54 firmly in place in one of the arms 76, 78 of the respective slotted opening 60" so the pin and guide surface assembly 56, 54 will not fall out of the frame. Of course, the enlargement at the bottom end of the pin, whether it is a cotter pin, a nut, or any other enlargement, is large enough to prevent the pin from pulling upwardly out of the lower slotted opening 60".

Referring back to FIGS. 22-24, it can be seen that the same pin used in the circular openings 60 may be used in the slotted openings 60". It also may be desirable to keep the left and right end pins in place and to store a spare pin and guide surface assembly 56, 54 in the glove compartment of the vehicle or elsewhere so the user can just use the spare pin and guide surface in the slotted openings when the winch is pulling in a skewed direction. Of course, if there is no spare pin, the user may remove one of the end pins and use it in the slotted openings, gradually moving it from one discrete position to the next along the length of the drum 14.

Figure 25:
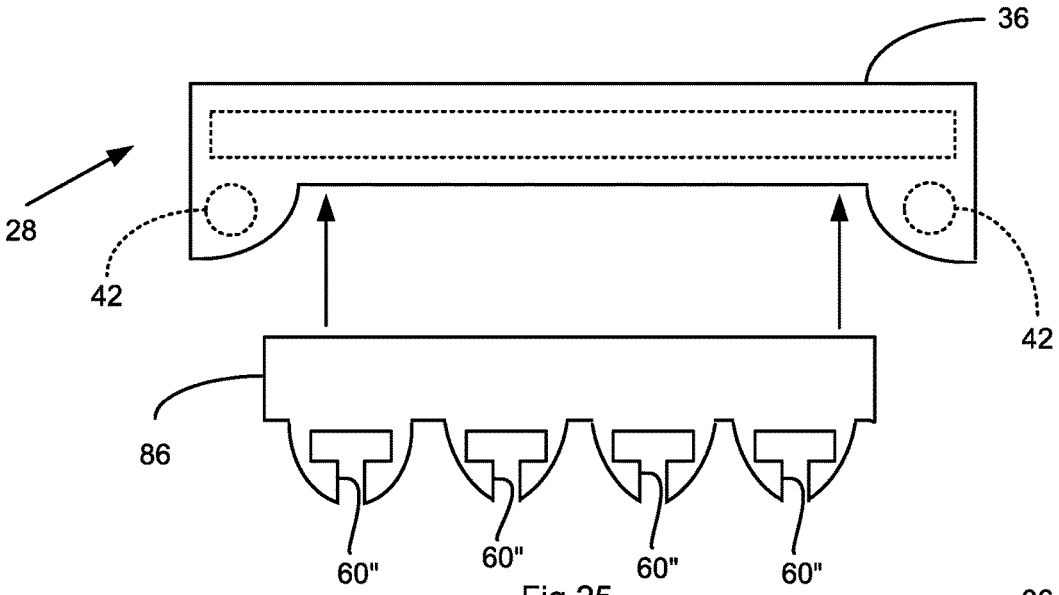
FIG. 25 is a partially exploded, top view of a prior cable guide and of a top plate, very similar to that of FIG. 24, for a kit to modify the prior art cable guide to make it equivalent to the embodiment of FIG. 23.
Figure 26:
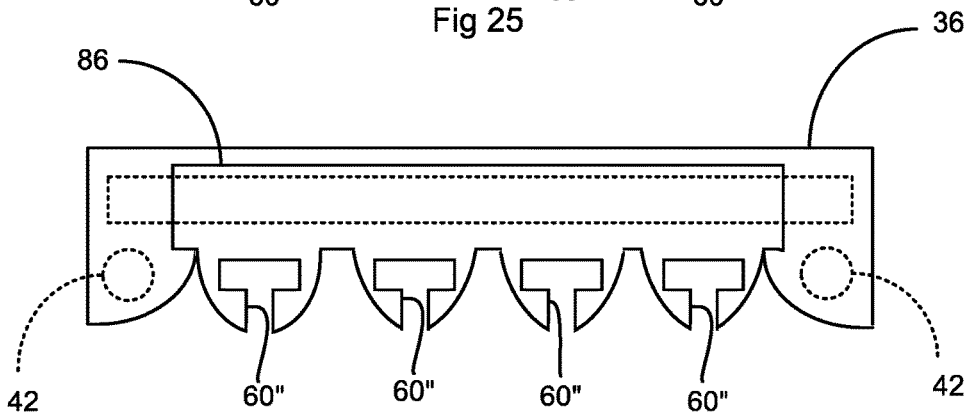
FIG. 26 is a top view of the assembled modified cable guide of FIG. 25.

FIGS. 25 and 26 show how a kit can be installed onto a prior art roller cable guide (such as the cable guide 28 of FIG. 5). Identical top and bottom flat plates 86 are provided, each having the slotted openings 60" (or the circular openings 60) of the desired cable guide frame.

These top and bottom plates 86 are secured (as by welding or bolting, for instance) to the frame 36 of the cable guide 28, as shown in FIG. 26 such that the upper and lower pairs of openings 60 or 60" are vertically aligned. One of the plates 86 is secured to the top of the frame of the cable guide 28 and the second plate 86 is secured to the bottom of the frame of the cable guide 28. The existing vertical rollers 42 of the cable guide 28 may be left in place if desired. These vertical rollers 42 typically are threaded and secured by a nut, so they are removable and could be removed from the end position and then moved from one paired set of upper and lower slotted openings 60" to the next. Alternatively, they could be replaced by pin having a securement that is easier to use. Also, a spare pin and roller assembly 56, 54 may be supplied to be used with the slotted openings 60", as described above.

It should be noted that the terms left and right, and upper and lower are relative positions, so it is understood that the winch could be mounted in various positions on a vehicle, with the cable guide being mounted in a corresponding position to work with the winch. It will be obvious to those skilled in the art that modifications may be made to the embodiments described above without departing from the scope of the present invention as claimed.

What is claimed is:

1. A winch arrangement, comprising:

a winch, including a drum having a left-to-right axis of rotation, a drum length in the direction of said axis, and a center point along said drum length; and a cable guide mounted adjacent to said drum; said cable guide comprising a bracket extending in a left-to-right direction; wherein said bracket defines at least three sets of upper and lower paired openings spaced apart across said left-to-right-extending bracket, with at least a leftmost set of upper and lower paired openings located to the left of said center point, at least a rightmost set of upper and lower paired openings located to the right of said center point, and at least one intermediate set of upper and lower paired openings located intermediate said leftmost and rightmost sets; wherein, in a first mounting arrangement, a leftmost guide surface is mounted in said leftmost set of upper and lower paired openings, and a rightmost guide surface is mounted in said rightmost set of upper and lower paired openings, thereby defining a first space between said leftmost and rightmost guide surfaces for receiving a cable to pass through said first space onto said drum, said first space being sufficient to enable the cable to wind along the entire drum length, and wherein, in a second mounting arrangement, an intermediate guide surface is mounted on said intermediate set of upper and lower paired openings, and another guide surface is mounted on any other set of said upper and lower paired openings to provide a shorter space between guide surfaces in order to guide said cable onto a more restricted portion of said drum.

2. A winch arrangement as recited in claim 1, wherein at least one of said guide surfaces is rotatable on a pin.

3. A winch arrangement as recited in claim 2, wherein said pin is magnetized.

4. A winch arrangement as recited in claim 1, wherein said upper and lower paired openings are circular.

5. A winch arrangement as recited in claim 4, wherein at least said upper openings are slotted.

6. A winch arrangement as recited in claim 5, wherein both said upper and lower paired openings are slotted.

7. A winch arrangement as recited in claim 5, wherein said pin is magnetized.

* * * * *